US008944440B2

(12) United States Patent
Elkinton

(10) Patent No.: US 8,944,440 B2
(45) Date of Patent: Feb. 3, 2015

(54) RIDER CONTROLLABLE SKIMBOARD

(75) Inventor: John Elkinton, Bonita, CA (US)

(73) Assignee: John Elkinton, Bonita, CA (US)

( * ) Notice: Subject to any disclaimer, the term of this patent is extended or adjusted under 35 U.S.C. 154(b) by 0 days.

(21) Appl. No.: 13/615,437

(22) Filed: Sep. 13, 2012

(65) Prior Publication Data

US 2014/0070503 A1 Mar. 13, 2014

(51) Int. Cl.
*B62B 9/04* (2006.01)

(52) U.S. Cl.
USPC ..... 280/14.28

(58) Field of Classification Search
USPC ..... 280/14.28, 14.21, 14.27, 21.1, 28.11, 280/14.25, 22.1, 87.041, 87.042, 603, 609, 280/11.14, 11.15, 809, 817, 818, 15–17
See application file for complete search history.

(56) References Cited

U.S. PATENT DOCUMENTS

| | | | | |
|---|---|---|---|---|
| 3,027,574 | A | 4/1962 | Meehan | |
| 3,378,274 | A * | 4/1968 | Poppen | 280/18 |
| 3,529,847 | A * | 9/1970 | Shores | 280/14.22 |
| 3,579,682 | A | 5/1971 | Wood | |
| 4,129,313 | A * | 12/1978 | Benson | 280/14.27 |
| 4,707,884 | A * | 11/1987 | Chang | 16/440 |
| 4,756,700 | A * | 7/1988 | Coleman | 441/65 |
| 6,199,880 | B1 * | 3/2001 | Favorito et al. | 280/87.042 |
| 6,213,484 | B1 * | 4/2001 | Rohner | 280/87.042 |
| 6,217,073 | B1 * | 4/2001 | Hoffman | 280/823 |
| 6,367,828 | B1 * | 4/2002 | Mandic | 280/87.05 |
| 6,520,516 | B2 * | 2/2003 | Favorito et al. | 280/87.042 |
| 7,163,209 | B2 * | 1/2007 | Moscaret et al. | 280/8 |
| 7,232,350 | B1 | 6/2007 | Krah | |
| 7,374,180 | B2 * | 5/2008 | Farmer | 280/14.27 |
| 8,240,714 | B2 * | 8/2012 | Lopez | 280/810 |
| 2003/0085539 | A1 | 5/2003 | Cochimin | |
| 2010/0099313 | A1 | 4/2010 | Morgan | |

FOREIGN PATENT DOCUMENTS

| | | | |
|---|---|---|---|
| AU | 2010100732 | A4 | 8/2010 |
| EP | 1693088 | A1 | 8/2006 |
| GB | 2486447 | A | 6/2012 |
| WO | WO-9911338 | A1 | 3/1999 |
| WO | WO-0054856 | A1 | 9/2000 |

* cited by examiner

*Primary Examiner* — John Walters
*Assistant Examiner* — James Triggs
(74) *Attorney, Agent, or Firm* — Mintz Levin Cohn Ferris Glovsky and Popeo, P.C.

(57) ABSTRACT

A rider-controllable skimboard includes a planar board having a top surface and a connection mechanism mounted to the top surface and proximate a nose of the planar board. The connection mechanism has a vertical pivoting mechanism and a lateral pivoting mechanism. The skimboard further includes a handle mechanism connected with the vertical pivoting mechanism and the lateral pivoting mechanism of the connection mechanism for respective limited vertical pivoting and lateral pivoting of the handle relative to the planar board. The handle mechanism has a length of 80 to 120 percent of a length of the board, such that in a non-pivoted position a handgrip connected with the handle mechanism is positioned within 20 percent of the length of the board from the tail, and such that the limited vertical pivoting of the handle by the rider positions the upper stem portion substantially horizontal and proximate the rider's waist.

19 Claims, 9 Drawing Sheets

RIDER CONTROLLABLE SKIMBOARD

BACKGROUND

Skimboarding, also called "skimming" is a boardsport in which a thin, typically fin-less board, i.e. a skimboard, is used to skim glide along the surface of water. Skimboards are typically smaller and lighter than surfboards, and are usually carried by a rider from a dry beach to a thin wash of beach break, and then dropped free into the water with as much forward momentum as possible or desired. Riders then run and hop onto the moving skimboard, and, use their momentum to skim along a thin layer of wash in a straight fashion or to perform tricks (called "flatlanding"), or to catch the wash out to the beach break, which a rider can then ride much like conventional surfing.

Conventional skimboards are controllable only by a rider's stance and weight shift. Problems can exist when a rider drops the skimboard onto the water, since the rider can no longer control the direction, speed or other movement of the skimboard until after only mounting the skimboard. Likewise, control of the direction, speed and movement of a mounted skimboard is limited to a stance and weight-shifting of a rider once the rider has mounted the skimboard.

SUMMARY

This document describes a rider-controllable skimboard. In one aspect, the skimboard includes a planar board having a top surface, a smooth bottom surface, a nose, a tail, and opposing side edges between the nose and the tail. The skimboard further includes a connection mechanism mounted to the top surface of the planar board, the connection mechanism having a vertical pivoting mechanism. The skimboard further includes a handle mechanism connected with the vertical pivoting mechanism of the connection mechanism for limited vertical pivoting of the handle relative to the planar board. The handle mechanism has a lower stem portion and at least one handgrip that extends laterally outward from the lower stem portion, the lower stem portion having a length of 80 to 120 percent of a length of the board, such that in a non-pivoted position the handgrip is positioned within 20 percent of the length of the board from the tail, and such that the limited vertical pivoting of the handle mechanism by the rider positions the upper stem portion substantially horizontal and proximate the rider's waist.

In another aspect, the connection mechanism has a vertical pivoting mechanism and a lateral pivoting mechanism, and the handle mechanism is connected with the vertical pivoting mechanism and the lateral pivoting mechanism of the connection mechanism for respective limited vertical pivoting and lateral pivoting of the handle relative to the planar board.

The details of one or more embodiments are set forth in the accompanying drawings and the description below. Other features and advantages will be apparent from the description and drawings, and from the claims.

BRIEF DESCRIPTION OF THE DRAWINGS

These and other aspects will now be described in detail with reference to the following drawings.

Like reference symbols in the various drawings indicate like elements.

DETAILED DESCRIPTION

Figure 1:
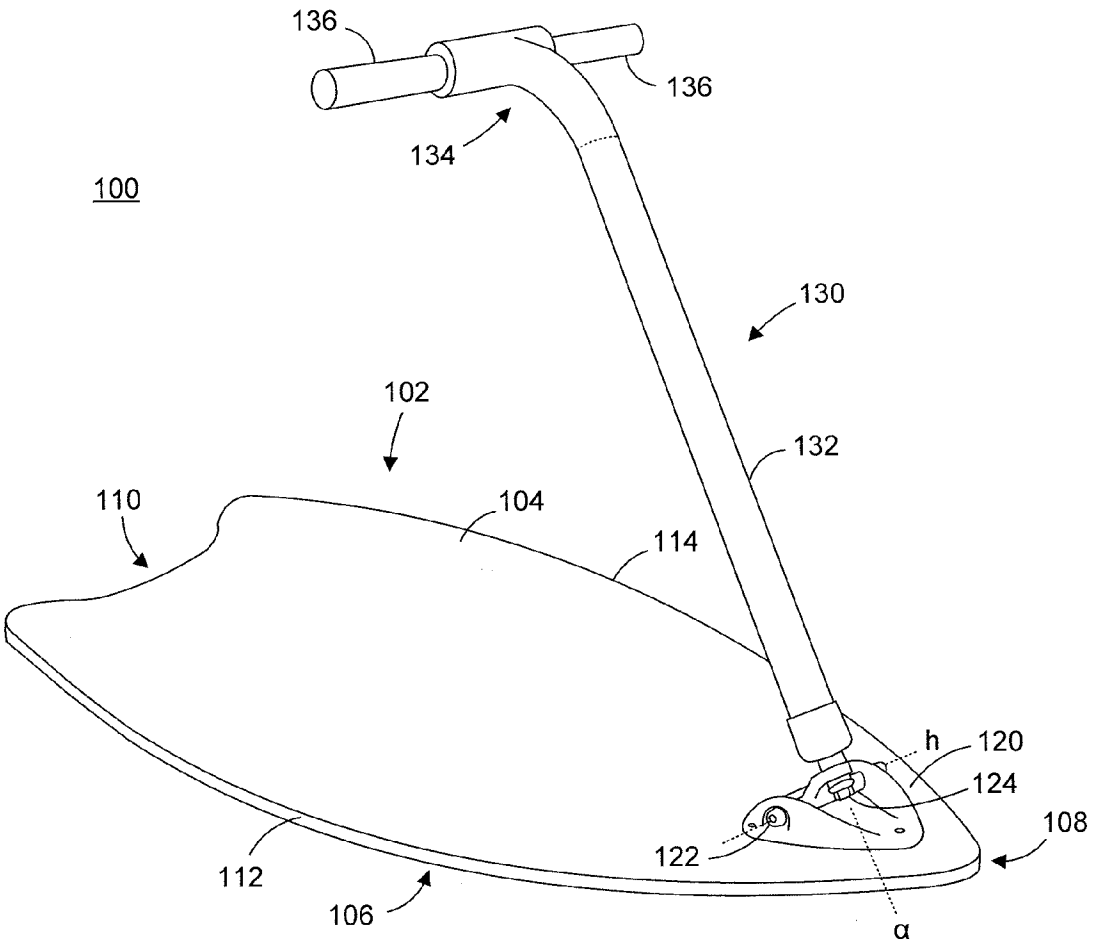
FIG. 1 is a perspective view of a skimboard with a handle mechanism.
Figure 2:
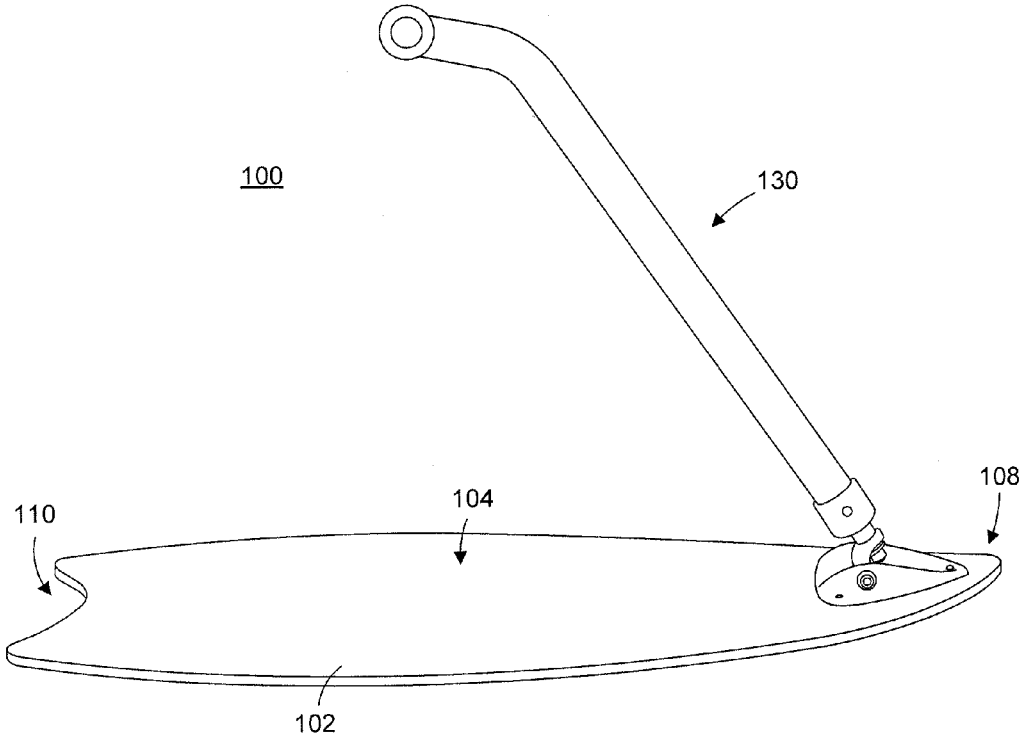
FIG. 2 is a side perspective view of a skimboard with a handle mechanism.

This document describes a rider-controllable skimboard. The skimboard as described herein is not only ridable by a rider, but can also be controlled by way of a handle mechanism that can be gripped by a hand of a user for propelling the attached skimboard in a forward direction, providing leverage for a rider to stand or otherwise mount the skimboard, and/or steering or controlling the skimboard to perform turns and tricks on the water, or other unexpected moves that would otherwise be impossible without the handle mechanism.

In preferred implementations, as shown in FIGS. 1-8, a skimboard 100 is not only ridable but includes further rider controls that yield unexpected results beyond those achieved by conventional skimboards. In some implementations, the skimboard 100 includes a substantially planar board 102 and a handle mechanism 130 that cooperates with the planar board 102 in a number of ways, as further described herein. A rider can control the planar board 102 via the handle mechanism 130, such as pushing a handle of the handle mechanism 130 while running to force forward momentum and planing of the planar board 102. Or, the rider can operate the handle 130, in combination with leaning to change a weight of the rider on the skimboard 100, to impose turning and directionality to the planar board 102, and to accomplish various tricks or maneuvers that cannot be accomplished with a conventional skimboard.

The planar board 102 has a top surface 104, a bottom surface 106, a nose 108, a tail 110, and outwardly curved right and left side edges 112 and 114 between the nose 108 and the tail 110. In some implementations, the planar board 102 is formed of one or more thin plies, layers or laminates of one or more materials, such as wood, plastic, carbon fiber, fiberglass, or the like. In other implementations, the planar board 102 is formed of a hollow core surrounded by a rigid or semi-rigid skin of one or materials, such as wood, plastic, carbon fiber, fiberglass, or the like. In yet other implementations, the planar board 102 is formed of a buoyant material core, such as polyvinyl carbonate (PVC), expanded polystyrene (EPS), expanded polypropylene (EPP), or the like, surrounded by a rigid or semi-rigid skin of one or more of the materials described above.

The substantially planar board 102 is completely flat in some implementations, but may also have a rocker, or upward curve, at the nose 108 and/or tail 110, and the rocker may be very slight or may be pronounced. The rocker can be limited to an extent 5-50% of the length of the planar board 102 toward the nose 108 and/or tail 110 from a midpoint along a length of the planar board 102. The top surface 104 of the planar board 102 is preferably flat, but can be provided with one or more gripping surfaces such as a grainy adhesive, or compressible material such as foam in the form of a top layer or partial top layer, such as a "stomp pad," EVA traction foam, or similar materials. Alternatively, the top surface 104 can include any number of grooves, indents, detents, or the like, for receiving a rider's foot or providing a general area for positioning of the rider's feet while riding the skimboard 100. While the bottom surface 106 is preferably smooth and free of protrusions, in some implementations the bottom surface 106 can have any number of applied surface materials, such as polystyrene (EPS), expanded polypropylene (EPP), or the like, adhered to the bottom surface 106 as to create less resistance while enhancing planing of the planar board 102 over the water's surface. The bottom surface 106 can also have any number of contours such as channels, grooves, protrusions, rails or edges, however slight or pronounced. These contours can be provided to support directionality, control, and other types of characteristics for the planar board 102.

The nose 108 of the planar board 102 is preferably pointed or slightly truncated at its apex, but can be rounded or even squared. The nose 108 represents the forward 10 to 30% of the length of the board, and can define a nose kick, or upward curvature or rocker, of the skimboard 100. In preferred exemplary implementations, the planar board 102 is substantially flat and has a uniform thickness, while in some implementations the thickness of the planar board 102 thins toward the nose 108 to provide a slight upward curvature of the bottom surface 106 of the planar board 102 at the nose 108, facilitating planing on water during forward movement or momentum of the planar board 102.

The tail 110 of the planar board 102 can include a rounded edge, a straight edge or any of a number of curvilinear edges. The tail 110 can be shaped to minimize friction as the planar board 102 planes and moves over water, and to maximize speed. In some implementations, the tail 110 can be a point between the distal ends of right and left side edges 112, 114. In preferred implementations, the tail 110 of the planar board 102 is formed to allow a rider to grasp the handle mechanism 130 while running forward, which also can cause the rider to lean forward during such running, and not step on the planar board 102.

The handle mechanism 130 is connected to the planar board 102 by a connection mechanism 120, which is preferably mounted to the top surface 104 and proximate the nose 108 of the planar board 102. The connection mechanism 120 includes a vertical pivoting mechanism 122 to allow the handle mechanism 130 to pivot from the planar board 102 relative to a horizontal axis h.

The handle mechanism 130 includes a lower stem portion 132 and an upper stem portion 134 connected at an angle to the lower stem portion 132. The angle between an axis of at least substantially the lower stem portion 132 and an axis of at least a distal end of the upper stem portion 134 can be between 5 and 85 degrees, and is preferably between 20 and 40 degrees. The handle mechanism 130 further includes at least one handgrip 136 that extends laterally outward proximate the distal end of the upper stem portion 134. The handgrip 136 and/or upper step portion 134 can also be formed to pivot or rotate sidewise relative to lower stem portion 132. The handgrip 136 can include a water-resistant, compressible material that also forms friction with a rider's hand, such as a foam or a polyurethane gel or the like.

The handle mechanism 130 can be formed in whole or in part by metal tubing, polyvinyl carbonate tubing, or other rigid or semi-rigid material. The handle mechanism 130 can be hollow or solid. In yet other implementations, the handle mechanism 130 can form a looping structure, as shown in FIG. 9. The handgrip 136 can include a straight or curved bar, much like a bicycle handlebar, or can include a wagon like handle with a handgrip member that defines an opening, such as a circular or other geometrical aperture, into which a rider can place his or her hand and grip any portion of the handgrip member.

Figure 3:
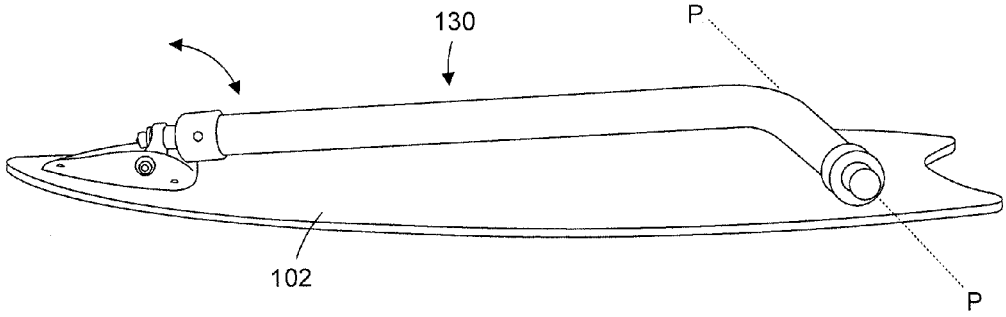
FIG. 3 is a side perspective view of a skimboard, with the handle mechanism in a non-pivoted position.
Figure 5:
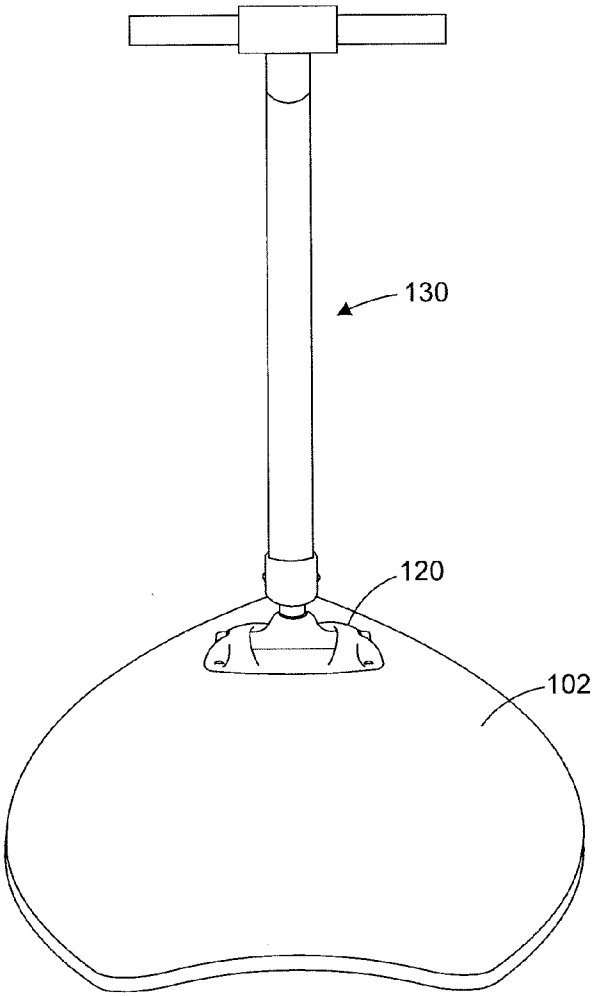
FIG. 5 is a rear perspective view of a skimboard with a handle mechanism.
Figure 4:
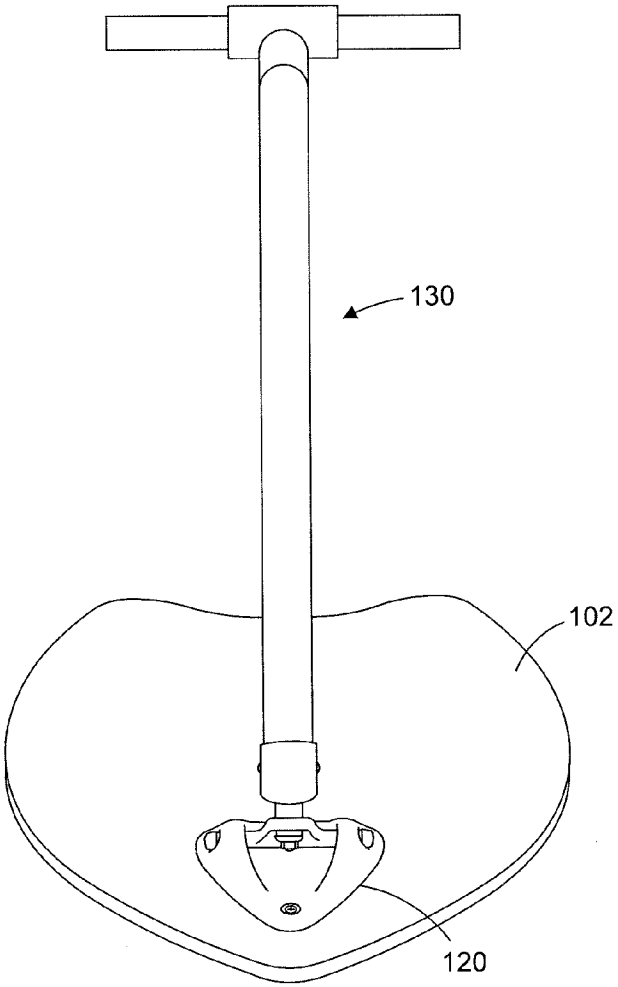
FIG. 4 is a front perspective view of a skimboard with a handle mechanism.
Figure 7:
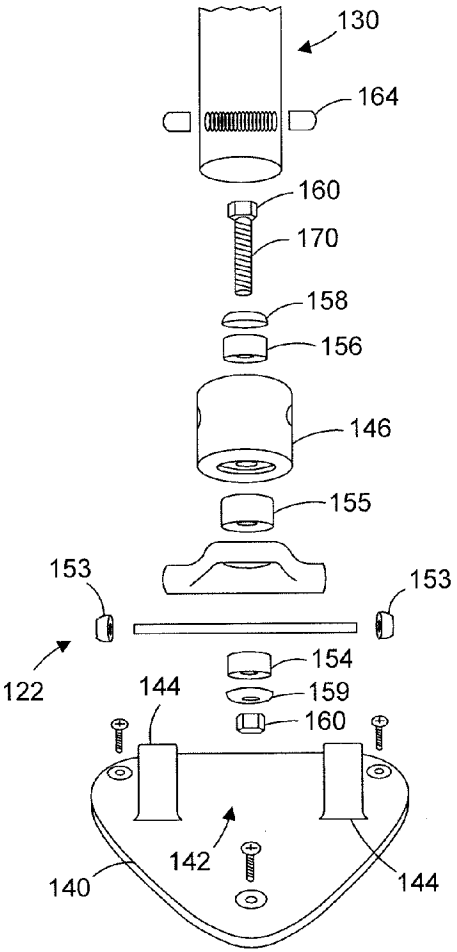
FIG. 7 is an exploded view of the connection mechanism in accordance with some implementations.

In exemplary implementations, the lower stem portion 132 has a length of 70 to 120 percent of a length of the board, such that in a non-pivoted position, i.e. where the handle mechanism 130 is laying substantially parallel to the top surface 104 of the planar board 102, as shown in FIG. 3, the handgrip 136 is positioned at a position P that is within 2 to 20 percent of the length of the board from the tail, and preferably within 10 inches of the tail of the board, and more preferably within 5 inches of the tail of the board. In yet other implementations, the lower stem portion 132 and/or upper stem portion 134 can be telescoping or otherwise have an adjustable length.

The overall length of the handle mechanism 130 is such that, with vertical pivoting of the handle by the rider, the upper stem portion 134 can be positioned substantially horizontally, and the handgrip 136 can be positioned or held at or proximate a rider's waist, or at a height at or proximate the rider's waist. These feature is distinct from conventional or standard skimboards in that they enable an unexpected ability for a rider to both control the forward momentum of the planar board 102 solely or at least partially via the handle mechanism 130, while still being able to run or gain speed prior to standing on and riding the skimboard 100.

In some implementations, the connection mechanism 120 further includes a lateral pivoting mechanism 124. The lateral pivoting mechanism 124 can allow lateral pivoting of the handle mechanism 130 relative to the planar board 102, or axially relative to a point where the connection mechanism 120 is connected with the planar board 102. In some implementations, the lateral pivoting mechanism 124 can provide variable-resistance, omni-directional pivoting, relative to a plane of the planar board 102, i.e. a pivoting away, in any direction, from an axis parallel to the axis formed by the lower stem portion 132 of the handle mechanism 130. Accordingly, the vertical pivoting mechanism 122 and, in some implementations, the lateral pivoting mechanism 124 of the connection mechanism 120 enables respective limited vertical pivoting and lateral pivoting of the handle relative to the planar board 102. These features are also distinct from conventional skimboards or surfboards, in that they enable a rider to control, at least in a limited way, the direction, turning, pitch and movement of the skimboard 100. Implementations of the lateral pivoting mechanism 124 are described in further detail below.

In some implementations, the planar board 102 is constructed of a foam core, such as of polyvinyl carbonate or other type of structural foam, and reinforced on the top surface 104, bottom surface 106, and/or right and left edges 112, 114 with one or more reinforcing layers such as vinyl ester resin, fiberglass, or carbon fiber. These one or more reinforcing layers can be further reinforced with one or more layers of structured or unstructured fiberglass, or other strong, stiff layer, such as carbon fiber fabric. In other implementations, the planar board 102 is constructed of a hollow shell of carbon fiber, fiberglass, or other strong, stiff layers, which may be internally reinforced with an inner skeletal structure (not shown) of carbon fiber, aluminum, wood, or other rigid material. The connection mechanism 120 can be attached through the outer layer of the planar board 102 and to a portion of the inner skeletal structure, for additional structural integrity and support.

In still other implementations, the planar board 102 is constructed of one or more layers of a solid, semi-stiff material such as wood ply, carbon fiber, fiberglass, plastic, glass-reinforced plastic, or any combination of the aforementioned materials. In preferred implementations, the planar board 102 should be stiff, yet have at least some give for flexible bending under weight of the rider or other stress.

Figure 6:
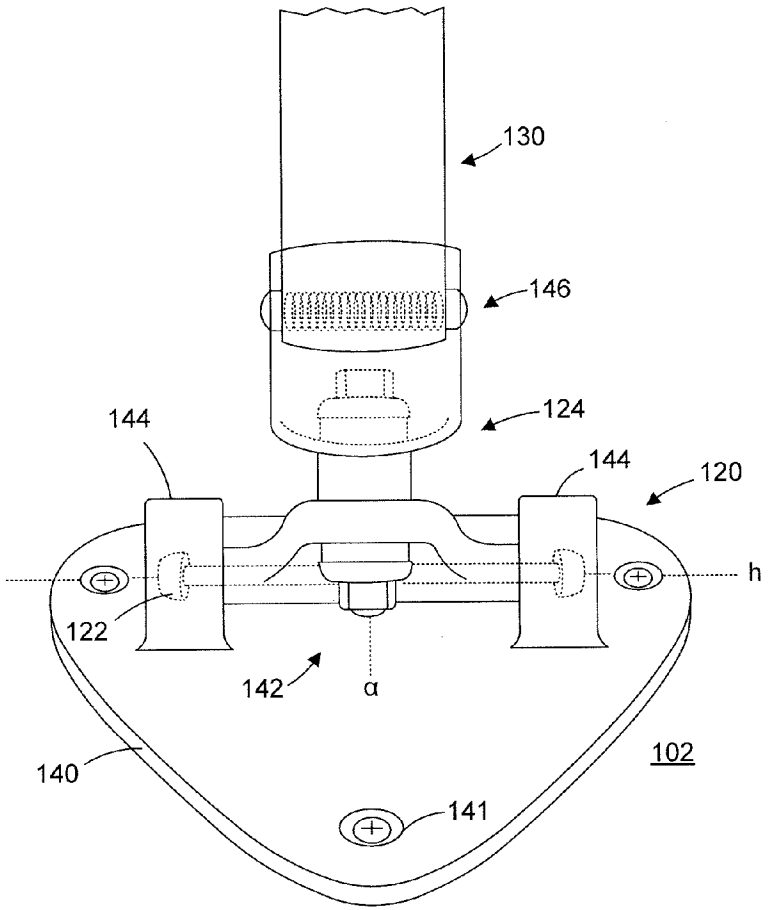
FIG. 6 is a detailed, close-up view of a connection mechanism to connect a handle mechanism to a planar board.
Figure 8:
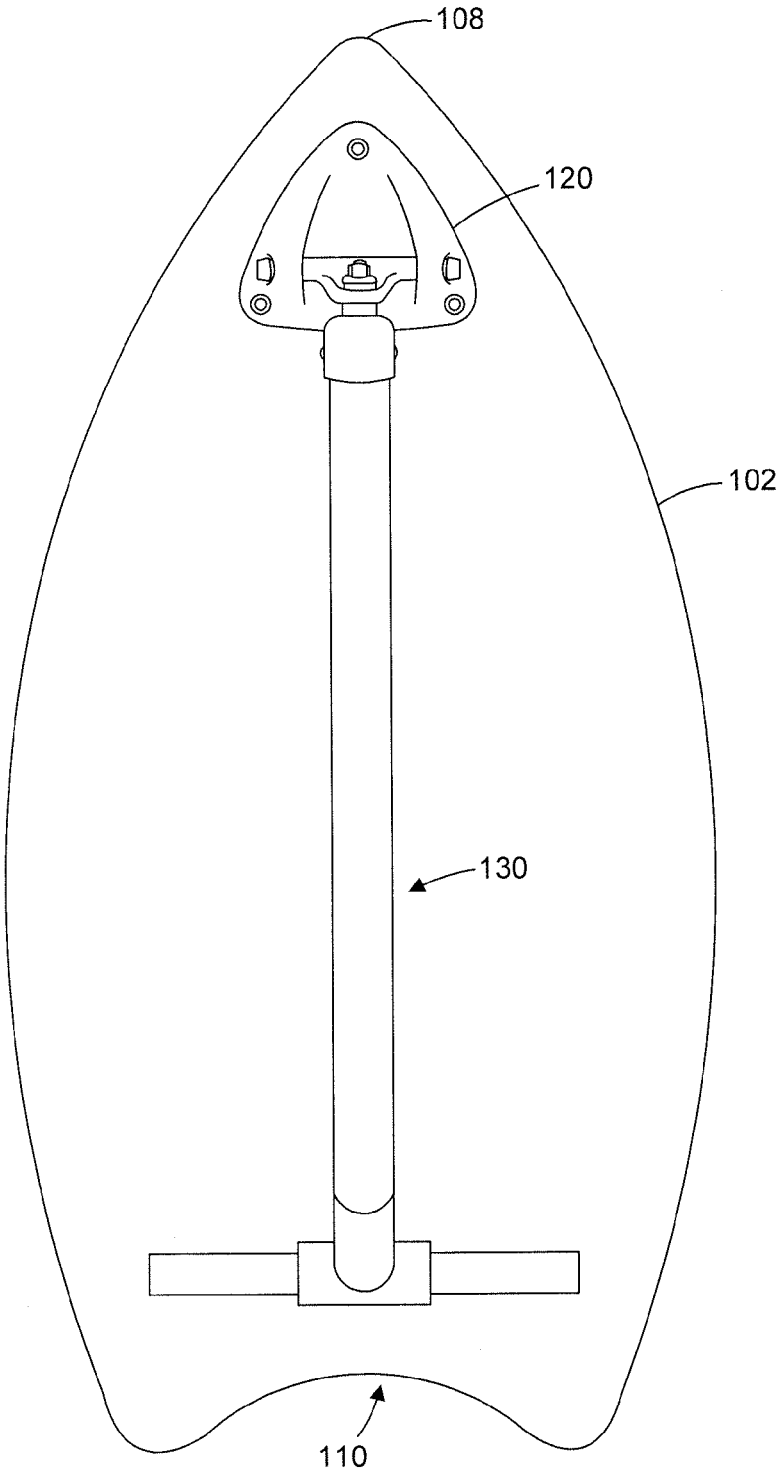
FIG. 8 is a top perspective view of a skimboard with a handle mechanism.

FIG. 6 shows a close-up view of the connection mechanism 120 for connecting the handle mechanism 130 to the planar board 102. In some implementations, the connection mechanism 120 is connected near the nose 108 of the planar board 102 and positions the handle mechanism 130 at an angle from the top surface 104 of the planar board 102, so as to position one or more hand grips 136 nearer a rider, and more particularly nearer a midsection or waist of the rider. In other implementations, the connection mechanism 120 includes a vertical pivoting mechanism 122 to allow the handle mechanism 130 to pivot vertically from the planar board 102 around a horizontal axis h. The connection mechanism 120 can also include a lateral pivoting mechanism 124 to allow the handle mechanism 130 to pivot laterally in any direction away from an axis a defined by at least a portion of the handle mechanism 130.

In some implementations, the connection mechanism 120 includes a base 140 that can be mounted to the planar board 102. The base 140 can be mounted to the planar board 102 by bolts 141, screws, glue, or any other mounting mechanism. The base 140 can have a triangular shape to accommodate a pointed shape of the nose 108 of the planar board. In some implementations, the base 140 include a center channel 142 defined on left and right sides by a ridge 144. The ridge 144 can include an aperture for receiving, for example, an axle or pin that defines the axis h, and around which the vertical pivoting mechanism 122 pivots. The base 140 can be formed of metal such as aluminum, steel, or the like, or of nylon, carbon fiber, reinforced plastic, or other material that is resistant to corrosion from water. Further, the base 140 can be wrapped in or otherwise covered with a waterproof layer to withstand the corrosive properties of water.

As shown in FIG. 6, the handle mechanism 130 connects to the connection mechanism 120 by connector interface 146. With additional reference to FIG. 7, which is an exploded view of the connection mechanism 120, the connection mechanism 120 includes a hanger 150 that includes a bushing seat 151, and which provides both the vertical pivoting mechanism 122 by angular rotation of the hanger 150, and the lateral pivoting mechanism 124 by flexible resistance against movement of the handle mechanism 130 from its original axis.

The hanger 150 includes an axle that sits within apertures through side ridges 144 on either side of center channel 142 of the base 140 and which is secured in place in the apertures and to the base 140 by caps 153, which can be bolts, screws or other securing device. A top bushing 152 is seated on the top of the bushing seat 151, and a bottom bushing 154 is seated on the bottom of the bushing seat 151. The connector interface 146 can be a cylindrical member with a center aperture within a bottom wall. A connector bushing 156 can be seated in the connector interface 146 opposite the bottom wall of the connector interface from the top bushing 152. All three bushings are sandwiched by top and bottom cup washers 158, 159, respectively, and which in turn are secured on kingpin 170 by bolts 160 on opposing distal ends of the kingpin 170. The bushings can be formed of a pliable, flexible material to provide limited, biased resistance yet flexibility in any lateral direction, or only in side-to-side directions.

The connector interface 146 can include a handle mounting mechanism to connect with the handle mechanism 130. For example, the connector interface 146 can be provided with two opposing side apertures that correspond to spring-loaded tabs 164 that extend from opposite sides of the handle mechanism 130 and which are biased outward by spring 162 or other biasing mechanism. The spring-loaded tabs 164 can be retracted to enter into the inner cavity of the connector interface 146, to extend through the two opposing side apertures once aligned. Those having skill in the art would recognize that other types of handle mounting or connection mechanisms can be used, including bolts, screws, glue, or the like.

In some implementations, a rider can adjust a stiffness of the lateral pivoting mechanism 124 by rotating the handle mechanism 130 or a portion thereof to put additional tension on the bushings, and therefore allow less flexibility by the bushings and greater resistance to lateral movement by the handle mechanism 130.

Figure 9A:
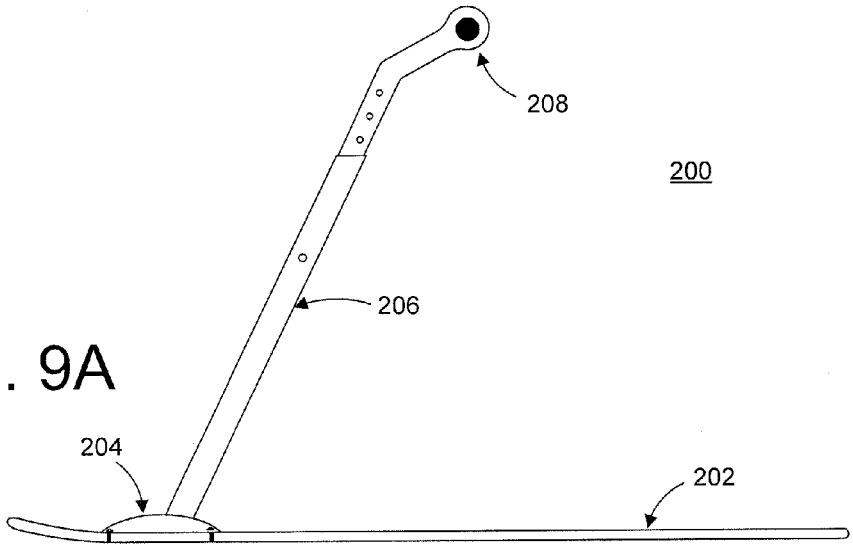
FIGS. 9A-9C illustrate a skimboard in accordance with an alternative implementation.
Figure 9B:
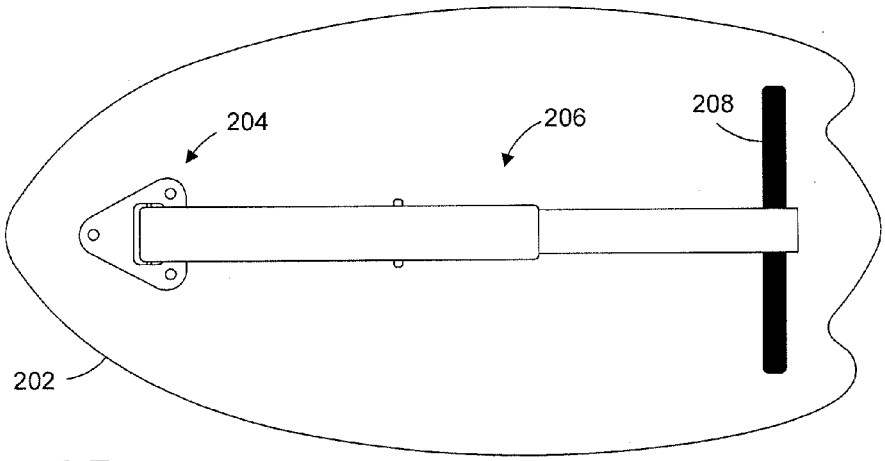
Figure 9C:
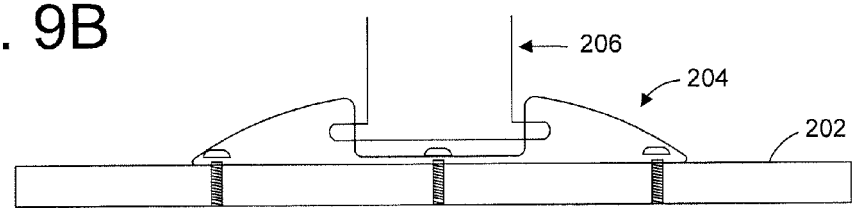

FIGS. 9A, 9B and 9C show a side view, top-down view and partial front view, respectively, of a skimboard 200 in accordance with an alternate implementation. The skimboard 200 includes a planar board 202, which can be similar to the planar board described above, a connection mechanism 204, a handle mechanism 206 and a handgrip 208. The connection mechanism 204 preferably includes only a vertical pivoting mechanism to allow the handle mechanism 204 to pivot up and down from the planar board 202. The handle mechanism 206 can be implemented as a telescoping member, or can be solid and non-extendable.

Figure 10A:
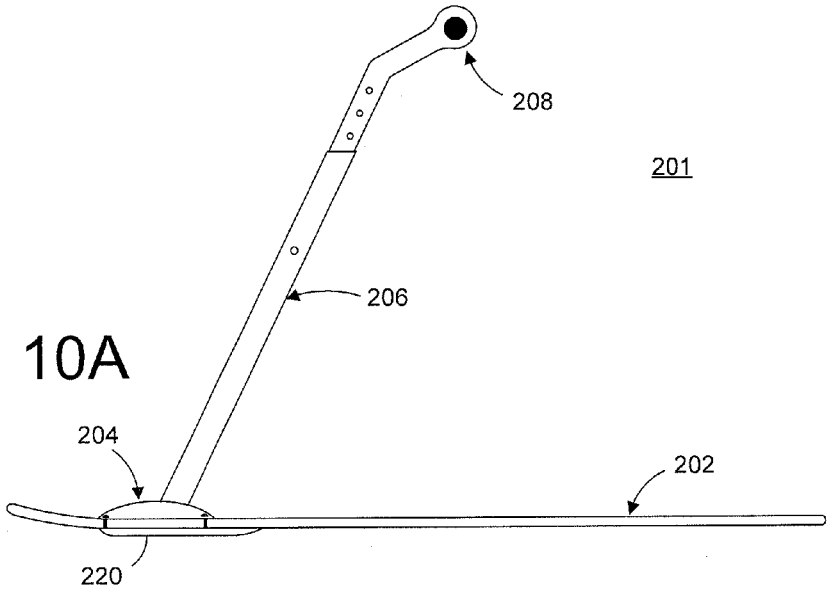
FIGS. 10A-10C illustrate a skimboard in accordance with another alternative implementation.
Figure 10B:
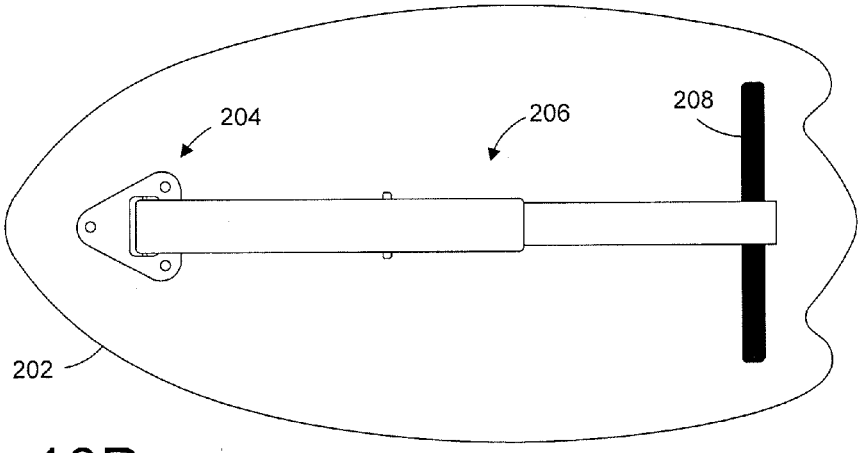
Figure 10C:
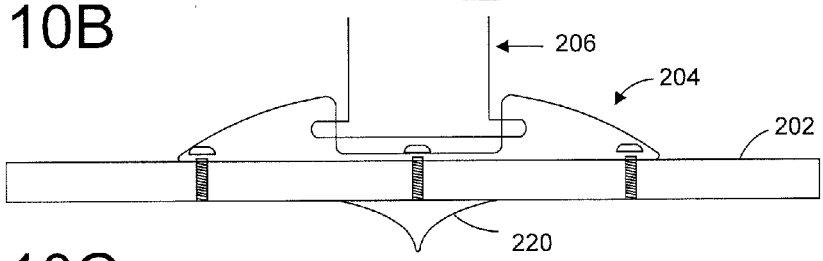

FIGS. 10A, 10B and 10C show a side view, top-down view and partial front view, respectively, of a skimboard 201, but also having at least one fin 220 extending down from a bottom surface of the planar board 202. The fin 220 is preferably small and elongated, and extends no more than 1 or 2 inches from the bottom surface of the planar board 202. In preferred implementations, the at least one fin 220 extends down from the bottom surface of the planar board 202 at or near a location of the connection mechanism 204, which is mounted on the top surface of the planar board opposite the at least one fin 220. The skimboard 201 can have two or more fins 220. The fins 220 can be located at the tail of the skimboard 201, the nose of the skimboard 201, or on either end near the sides of the skimboard 201. Alternatively, a fin 220 can be located in the center of the bottom surface of the skimboard 201.

Figure 11:
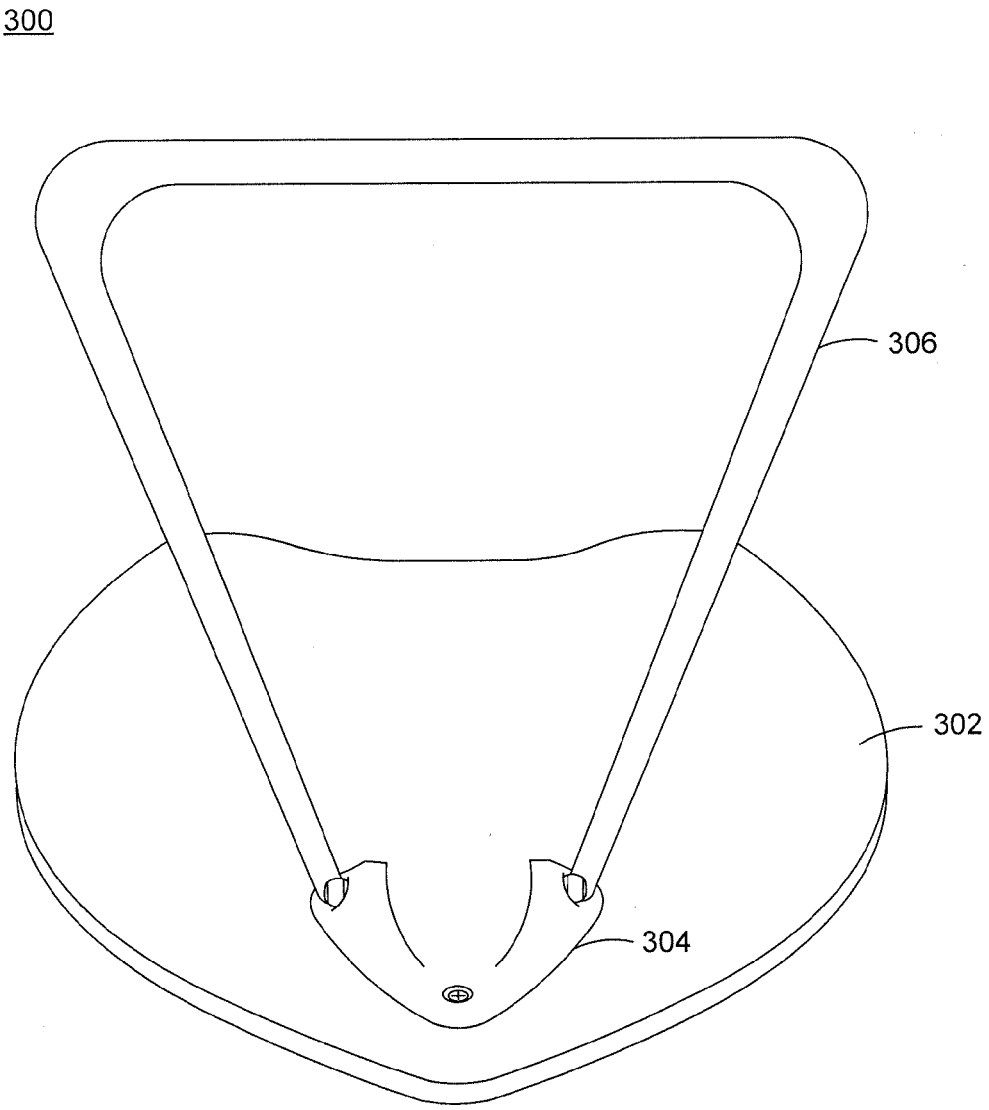
FIGS. 11 and 12 illustrate various alternative handle mechanisms.
Figure 12:
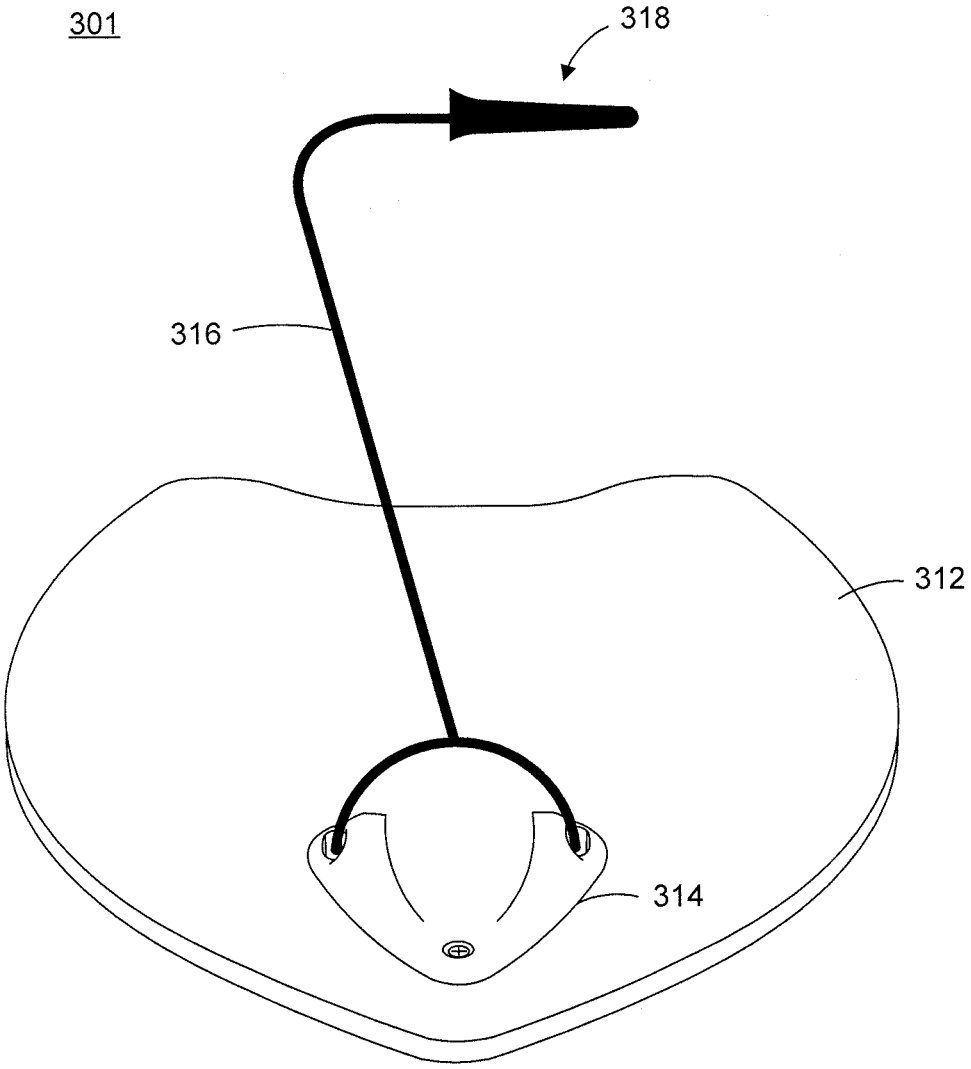

As discussed above, the handle mechanism of a skimboard in accordance with implementations described herein need not be linear or symmetrical. FIG. 11 illustrates a skimboard 300 having a triangular handle mechanism 306 coupled by a connection mechanism 304 to a planar board 302. The connection mechanism 304 includes at least a vertical pivoting mechanism to enable the handle mechanism 306 to pivot vertically from the planar board 302. FIG. 12 illustrates another skimboard 301 having a handle mechanism 316 connected to a planar board 312 via connection mechanism 314. The connection mechanism 314 includes at least a vertical pivoting mechanism, but can also include a lateral pivoting mechanism or even a lateral rotation or turning mechanism, which can also be locked into one of a number of positions. The handle mechanism 316 includes a lower stem portion extending from the connection mechanism 314 at a slight angle, and to which a handle portion 318 is connected and extends laterally. The handle mechanism 316 and handle 318 can take other shapes or arrangements as well.

Although a few embodiments have been described in detail above, other modifications are possible. Other embodiments may be within the scope of the following claims.

The invention claimed is:

1. A rider-controllable skimboard comprising:

a planar board having a top surface, a smooth bottom surface, a nose, a tail, and outwardly curved side edges between the nose and the tail;

a connection mechanism mounted to the top surface and proximate the nose of the planar board, the connection mechanism having a vertical pivoting mechanism and a lateral pivoting mechanism; and a handle mechanism connected with the vertical pivoting mechanism and the lateral pivoting mechanism of the connection mechanism for respective limited vertical pivoting and lateral pivoting of the handle relative to the planar board, the handle mechanism having a lower stem portion and an upper stem portion connected to the lower stem portion at an angle between 0 and 90 degrees, the handle further having at least one handgrip that extends laterally outward from the upper stem, the lower stem portion having a length of 80 to 120 percent of a length of the board, such that in a non-pivoted position the handgrip is positioned within 20 percent of the length of the board from the tail, and such that the limited vertical pivoting of the handle by the rider positions the upper stem portion substantially horizontal and proximate the rider's waist.

2. The rider-controllable skimboard in accordance with claim 1, wherein the limited lateral pivoting is between 0 and 30 degrees from a longitudinal axis of the board from the tail to the nose.

3. The rider-controllable skimboard in accordance with claim 1, further comprising a skeletal structure within the planar board, the connection mechanism being connected to a portion of the skeletal structure via the top surface of the planar board.

4. The rider-controllable skimboard in accordance with claim 1, wherein the planar board includes a rocker near the nose.

5. The rider-controllable skimboard in accordance with claim 1, wherein the handle mechanism has two handgrips extending laterally from the upper stem portion.

6. A rider-controllable skimboard comprising:

a planar board having a top surface, a smooth bottom surface, a nose, a tail, and outwardly curved side edges between the nose and the tail;

a connection mechanism mounted to the top surface and proximate the nose of the planar board, the connection mechanism having a vertical pivoting mechanism; and a handle connected with the vertical pivoting mechanism of the connection mechanism for limited vertical pivoting of the handle relative to the planar board, the handle mechanism having a lower stem portion and an upper stem portion connected to the lower stem portion at an angle between 0 and 180 degrees, the handle further having at least one handgrip that extends laterally outward from the upper stem, the lower stem portion having a length of 80 to 120 percent of a length of the board, such that in a non-pivoted position the handgrip is positioned within 20 percent of the length of the board from the tail, and such that the limited vertical pivoting of the handle by the rider positions the upper stem portion substantially horizontal and proximate the rider's waist.

7. The rider-controllable skimboard in accordance with claim 6, wherein the connection mechanism further includes a lateral pivoting mechanism for lateral pivoting of the handle relative to the planar board.

8. The rider-controllable skimboard in accordance with claim 7, wherein the limited lateral pivoting is between 0 and 30 degrees from a longitudinal axis of the board from the tail to the nose.

9. The rider-controllable skimboard in accordance with claim 6, further comprising a skeletal structure within the planar board, the connection mechanism being connected to a portion of the skeletal structure via the top surface of the planar board.

10. The rider-controllable skimboard in accordance with claim 6, wherein the planar board includes a rocker near the nose.

11. The rider-controllable skimboard in accordance with claim 6, wherein the handle mechanism has two handgrips extending laterally from the upper stem portion.

12. A rider-controllable skimboard comprising:

a planar board having a top surface, a smooth bottom surface, a nose, a tail, and opposing side edges between the nose and the tail;

a connection mechanism mounted to the top surface of the planar board, the connection mechanism having a vertical pivoting mechanism; and a handle mechanism connected with the vertical pivoting mechanism of the connection mechanism for limited vertical pivoting of the handle relative to the planar board, the handle mechanism having a lower stem portion and at least one handgrip that extends laterally outward from the lower stem portion, the lower stem portion having a length of 80 to 120 percent of a length of the board, such that in a non-pivoted position the handgrip is positioned within 20 percent of the length of the board from the tail, and such that the limited vertical pivoting of the handle mechanism by the rider positions the upper stem portion substantially horizontal and proximate the rider's waist, the handle mechanism further including an upper stem portion connected to the lower stem portion at an angle between 0 and 180 degrees, the at least one handgrip being connected to the lower stem portion via the upper stem portion.

13. The rider-controllable skimboard in accordance with claim 12, wherein the connection mechanism is connected with the top surface of the planar board and proximate the nose of the planar board.

14. The rider-controllable skimboard in accordance with claim 12, wherein the connection mechanism further includes a lateral pivoting mechanism for lateral pivoting of the handle relative to the planar board.

15. The rider-controllable skimboard in accordance with claim 14, wherein the limited lateral pivoting is between 0 and 30 degrees from a longitudinal axis of the board from the tail to the nose.

16. The rider-controllable skimboard in accordance with claim 12, further comprising a skeletal structure within the planar board, the connection mechanism being connected to a portion of the skeletal structure via the top surface of the planar board.

17. The rider-controllable skimboard in accordance with claim 12, wherein the planar board includes a rocker near the nose.

18. The rider-controllable skimboard in accordance with claim 12, wherein the handle mechanism has two handgrips extending laterally from the upper stem portion.

19. A rider-controllable skimboard comprising:

a planar board having a top surface, a smooth bottom surface, a nose, a tail, and opposing side edges between the nose and the tail;

a connection mechanism mounted to the top surface of the planar board, the connection mechanism having a vertical pivoting mechanism; and a handle mechanism connected with the vertical pivoting mechanism of the connection mechanism for limited vertical pivoting of the handle relative to the planar board, the handle mechanism having a lower stem portion and at least one handgrip that extends laterally outward from the lower stem portion, the lower stem portion having a length of 80 to 120 percent of a length of the board, such that in a non-pivoted position the handgrip is positioned within 20 percent of the length of the board from the tail, and such that the limited vertical pivoting of the handle mechanism by the rider positions the upper stem portion substantially horizontal and proximate the rider's waist, the connection mechanism further including a lateral pivoting mechanism for lateral pivoting of the handle relative to the planar board.

* * * * *